US005752630A

United States Patent [19]

Guo

[11] Patent Number: 5,752,630

[45] Date of Patent: May 19, 1998

[54] SPRAY GUN AND HANGER COMBINATION

[76] Inventor: Wen-Li Guo, No. 10, Fang Dong Road, Wen Gin Tsuen, Fang Yuan Hsiang, Chang Hua Hsien, Taiwan

[21] Appl. No.: 653,912

[22] Filed: May 28, 1996

[51] Int. Cl.[6] ..... B05B 15/06

[52] U.S. Cl. ..... 222/192; 239/289; 239/531; 40/642.01

[58] Field of Search ..... 40/642.01, 299; 239/289, 525, 530, 531; 222/180, 23, 192

[56] References Cited

U.S. PATENT DOCUMENTS

| | | | |
|---|---|---|---|
| 2,852,310 | 9/1958 | Francis | 239/530 X |
| 2,995,845 | 8/1961 | Fraser | 40/299 |
| 3,065,946 | 11/1962 | Berkow | 40/299 X |
| 3,227,268 | 1/1966 | Gringer | 40/299 X |
| 3,417,923 | 12/1968 | Carlson | 239/531 X |
| 3,428,220 | 2/1969 | Osrow | 222/180 X |
| 3,441,178 | 4/1969 | Dgetluck | 222/180 X |
| 3,799,447 | 3/1974 | Beal | 239/530 X |
| 5,160,092 | 11/1992 | Rose et al. | 239/530 X |
| 5,501,400 | 3/1996 | Kuo | 239/525 X |

FOREIGN PATENT DOCUMENTS

| | | | |
|---|---|---|---|
| 2579805 | 10/1986 | France | 40/299 |
| 2279692 | 1/1995 | United Kingdom | 40/299 |

*Primary Examiner*—Kenneth Bomberg
*Attorney, Agent, or Firm*—Charles E. Baxley

[57] ABSTRACT

A spray gun includes a panel secured on top by one or more connecting members. The panel includes an opening for hanging to a protruding nail and includes a displaying area for displaying information. The panel includes a link and includes a sleeve secured to the free end portion of the link for engaging on the front portion of the spray gun so as to protect the outer thread formed in the front portion of the spray gun.

1 Claim, 1 Drawing Sheet

SPRAY GUN AND HANGER COMBINATION

BACKGROUND OF THE INVENTION

1. Field of the Invention

The present invention relates to a spray gun, and more particularly to a spray gun and hanger combination.

2. Description of the Prior Art

Typical spray guns comprise a body that is normally received in an envelope or a package for displaying purposes. The package should include a large volume for receiving the spray gun therein. This may waste a great amount of packaging materials.

The present invention has arisen to mitigate and/or obviate the afore-described disadvantages of the conventional spray gun packages.

SUMMARY OF THE INVENTION

The primary objective of the present invention is to provide a spray gun having an integral hanger provided thereon for displaying purposes.

The other objective of the present invention is to provide a spray gun having an element formed and provided in the hanger.

In accordance with one aspect of the invention, there is provided a spray gun and hanger combination comprising a spray gun body including an upper portion and including a front portion, a panel provided on top of the upper portion of the spray gun body, and at least one connecting member connecting the panel to the spray gun body. The panel includes an opening formed therein for hanging purposes and includes a displaying area provided therein for displaying purposes.

The front portion of the spray gun body includes an outer thread formed therein, the panel includes a link extended therefrom and includes a sleeve secured to the link for engaging on the front portion of the spray gun body so as to protect the outer thread.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
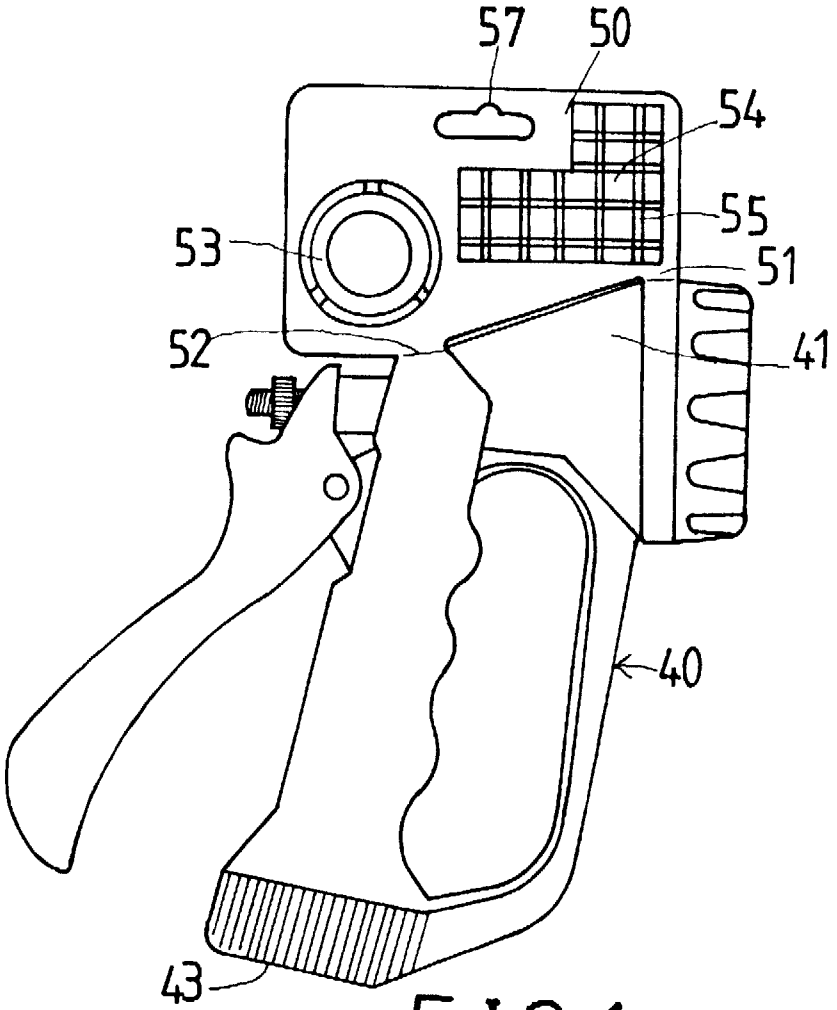
FIG. 1 is a plane view of a spray gun and hanger combination in accordance with the present invention.

Referring to the drawings, and initially to FIG. 1, a spray gun and hanger combination in accordance with the present invention comprises a spray gun body 40 including an upper portion 41 and including a lower portion 43 having a typical water inlet formed therein. The combination includes a panel 50 secured on top of the upper portion 41 of the spray gun body 40 and includes one or more connecting portions 51, 52 for connecting the panel 50 to the upper portion 41. The panel 50 includes a gasket 53 formed therein which can be removed and engaged in the water inlet (provided in the lower portion 43 of the spray gun body 40). The panel 50 further includes a displaying area 54 having a grid configuration 55 formed therein for illustrating or for displaying the information of the spray gun and hanger combination. The panel 50 further includes an opening 57 for hanging onto a protruding nail so as to display the spray gun.

It is to be noted that the panel 50 and the connecting portions 51, 52 can be formed integral with the upper portion 41 of the spray gun body 40 in the molding processes for forming the spray gun and hanger combination. It is further to be noted that the panel 50 may include a relatively smaller size that is good enough for hanging the spray gun to a protruding nail. The gasket 53 can be suitably retained in the panel 50 without further packaging member.

Figure 2:
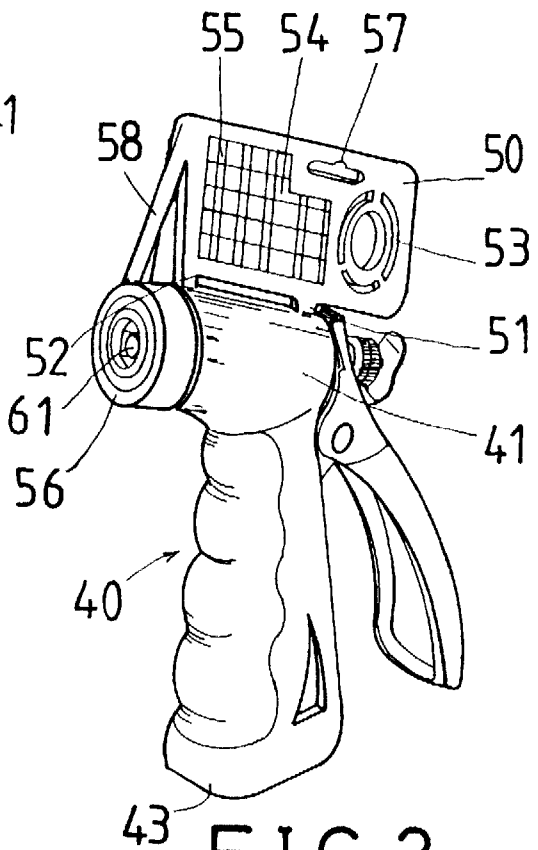
FIG. 2 is a perspective view of another application of the spray gun and hanger combination.
Figure 3:
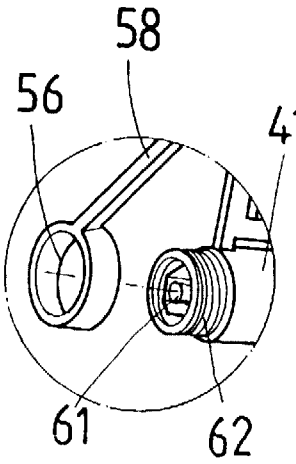
FIG. 3 is a partial perspective view illustrating the front portion of the spray gun.

Referring next to FIGS. 2 and 3, the spray gun may include an outer thread 62 formed in the front portion 61 thereof for coupling caps or controlling nozzles thereto. The combination further includes a sleeve 56 connected to the panel 50 by a link 58. The sleeve 56 is provided for engaging on the front portion 61 of the spray gun body 40 so as to enclose and to protect the outer thread 62.

Accordingly, the spray gun and hanger combination in accordance with the present invention includes an integral hanger provided thereon for hanging onto a protruding nail and for displaying purposes. The panel may also includes a part or an element that is to be engaged in the spray gun.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A spray gun and hanger combination comprising:

a spray gun body including an upper portion and including a front portion, a panel provided on top of said upper portion of said spray gun body, said panel including an opening formed therein for hanging purposes and including a displaying area provided therein for displaying purposes, and at least one connecting member connecting said panel to said spray un body, said front portion of said spray gun body including an outer thread formed therein, said panel including a link extended therefrom and including a sleeve secured to said link for engaging on said front portion of said spray gun body so as to protect said outer thread.

* * * * *